US009896296B2

(12) United States Patent
Chikamoto et al.

(10) Patent No.: US 9,896,296 B2
(45) Date of Patent: Feb. 20, 2018

(54) CONVEYING APPARATUS AND TRAY UNIT

(71) Applicant: BROTHER KOGYO KABUSHIKI KAISHA, Nagoya-shi, Aichi-ken (JP)

(72) Inventors: Tadanobu Chikamoto, Nagoya (JP); Hideki Yamamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/437,544

(22) Filed: Feb. 21, 2017

(65) Prior Publication Data

US 2017/0283202 A1 Oct. 5, 2017

(30) Foreign Application Priority Data

Mar. 31, 2016 (JP) ..... 2016-069875

(51) Int. Cl.
*B65H 31/24* (2006.01)

(52) U.S. Cl.
CPC ..... *B65H 31/24* (2013.01); *B65H 2402/31* (2013.01); *B65H 2405/1117* (2013.01); *B65H 2405/1134* (2013.01); *B65H 2801/27* (2013.01)

(58) Field of Classification Search
CPC ..... B65H 31/24; B65H 2402/31; B65H 2405/1134; B65H 2405/1117
USPC ..... 271/213, 287
See application file for complete search history.

(56) References Cited

U.S. PATENT DOCUMENTS 5,535,012 A * 7/1996 Matsumoto ..... B65H 39/11 271/176
5,678,818 A * 10/1997 Hayashi ..... B42C 1/125 271/220
5,909,871 A * 6/1999 Takehara ..... B42C 1/125 270/58.07
6,257,572 B1 * 7/2001 Yamada ..... B65H 39/11 271/279
8,469,352 B2 * 6/2013 Kunioka ..... B41J 13/103 271/164

FOREIGN PATENT DOCUMENTS

JP 3932792 B2 6/2007
JP 4204934 B2 1/2009

* cited by examiner

*Primary Examiner* — Patrick Cicchino
(74) *Attorney, Agent, or Firm* — Merchant & Gould P.C.

(57) ABSTRACT

A conveying apparatus includes: receiving trays including (i) a lowest tray, (ii) a first receiving tray different from the lowest tray, and (iii) at least one second receiving tray including one second receiving tray disposed just below the first receiving tray; a conveying mechanism; and a supporter supporting the receiving trays. The conveying apparatus further includes a transmission mechanism configured to perform at least one of: transmission of upward movement of the first receiving tray from a receiving position to an upper position, to downward movement of the one second receiving tray from the receiving position to a lower position; and transmission of the downward movement of the one second receiving tray to the upward movement of the first receiving tray.

11 Claims, 10 Drawing Sheets

CONVEYING APPARATUS AND TRAY UNIT

CROSS REFERENCE TO RELATED APPLICATION

The present application claims priority from Japanese Patent Application No. 2016-069875, which was filed on Mar. 31, 2016, the disclosure of which is herein incorporated by reference in its entirety.

BACKGROUND

The following disclosure relates to a conveying apparatus including a plurality of receiving trays arranged in a vertical direction, and to a tray unit used for the conveying apparatus.

There is known conveying apparatuses each including a plurality of receiving trays arranged in a vertical direction. One example of the conveying apparatuses is a printer including five sheet-output trays (receiving trays) arranged in a vertical direction. Each of the five sheet-output trays includes: a fixed portion fixed to the printer; and a movable portion located downstream of the fixed portion in a conveying direction in which a sheet is conveyed. When a user takes out a medium from a receiving tray (a lower tray) different from the uppermost tray, upward bending of the movable portion of a receiving tray (an upper tray) disposed just above the lower tray increases a distance between a downstream end of the lower tray in the conveying direction and the upper tray in a direction orthogonal to a receiving surface of the lower tray. The increase in the distance makes it easy for the user to take out the medium from the lower tray.

SUMMARY

In the above-described construction, however, only the movable portion of the upper tray is bent upward without change of a position of the lower tray, which may make it difficult for the user to take out the medium (especially, the medium of a small size in the conveying direction) from the lower tray.

Accordingly, an aspect of the disclosure relates to a conveying apparatus and a tray unit allowing a user to easily take out a medium from a lower tray.

In one aspect of the disclosure, a conveying apparatus includes: a plurality of receiving trays each having a receiving surface configured to receive a medium, the plurality of receiving trays being arranged in a vertical direction, the plurality of receiving trays including (i) a lowest tray located at a lowest position among the plurality of receiving trays and (ii) a first receiving tray that is each of at least one of the plurality of receiving trays other than the lowest tray; a conveying mechanism configured to convey the medium to the receiving surface of one of the plurality of receiving trays, selectively; and a supporter supporting the plurality of receiving trays. The first receiving tray is supported by the supporter so as to be situated selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position. The plurality of receiving trays include: an uppermost tray located at a highest position among the plurality of receiving trays; and at least one second receiving tray that is at least one of the plurality of receiving trays other than the uppermost tray. Each second receiving tray of the at least one second receiving tray is supported by the supporter so as to be situated selectively to one of the receiving position and a lower position at which a position of a downstream end of said each second receiving tray in the conveying direction is lower than a position of the downstream end of said each second receiving tray located at the receiving position. The at least one second receiving tray includes one second receiving tray disposed just below the first receiving tray, with no receiving tray between the one second receiving tray and the first receiving tray. The conveying apparatus further includes a transmission mechanism configured to perform at least one of: transmission of upward movement that is movement of the first receiving tray from the receiving position to the upper position, to downward movement that is movement of the one second receiving tray disposed just below the first receiving tray from the receiving position to the lower position; and transmission of the downward movement of the one second receiving tray to the upward movement of the first receiving tray.

Another aspect of the disclosure, a tray unit is used for a conveying apparatus. The conveying apparatus includes (a) a plurality of receiving trays each having a receiving surface configured to receive a medium, the plurality of receiving trays being arranged in a vertical direction, the plurality of receiving trays including (i) a lowest tray located at a lowest position among the plurality of receiving trays and (ii) a first receiving tray that is each of at least one of the plurality of receiving trays other than the lowest tray, (b) a conveying mechanism configured to convey the medium to the receiving surface of one of the plurality of receiving trays, selectively, and (c) a supporter supporting the plurality of receiving trays. The tray unit includes the plurality of receiving trays. The first receiving tray is supported by the supporter so as to be situated selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position. The plurality of receiving trays include: an uppermost tray located at a highest position among the plurality of receiving trays; and at least one second receiving tray that is at least one of the plurality of receiving trays other than the uppermost tray. Each second receiving tray of the at least one second receiving tray is supported by the supporter so as to be situated selectively to one of the receiving position and a lower position at which a position of a downstream end of said each second receiving tray in the conveying direction is lower than a position of the downstream end of said each second receiving tray located at the receiving position. The at least one second receiving tray includes one second receiving tray disposed just below the first receiving tray, with no receiving tray between the one second receiving tray and the first receiving tray. The tray unit further includes a transmission mechanism configured to perform at least one of: transmission of upward movement that is movement of the first receiving tray from the receiving position to the upper position, to downward movement that is movement of the one second receiving tray disposed just below the first receiving tray from the receiving position to the lower position; and transmission of the downward movement of the one second receiving tray to the upward movement of the first receiving tray.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIGS. 4A and 4B are perspective views of a transmission mechanism and four receiving trays of a tray unit of an ink-jet printer according to a first embodiment, wherein FIG. 4A illustrates a state in which each of the receiving trays is located at a receiving position, and FIG. 4B illustrates a state in which the second receiving tray from the top is contacted by the third receiving tray from the top which is moved from the receiving position toward an upper position;

FIGS. 5A and 5B are perspective views of the transmission mechanism and the four receiving trays of the tray unit of the ink-jet printer according to the first embodiment, wherein FIG. 5A illustrates a state in which the uppermost tray is contacted by the second receiving tray from the top which is pushed upward by the third receiving tray from the top, and FIG. 5B illustrates a state in which the uppermost tray is moved from the receiving position to the upper position by being pushed upward by the second receiving tray from the top;

FIGS. 6A and 6B are perspective views of the transmission mechanism and the four receiving trays of the tray unit of the ink-jet printer according to the first embodiment, wherein FIG. 6A illustrates a state in which the lowest tray is located at a lower position, and FIG. 6B is a view for explaining changes in distance between an upstream end of a lower tray in a conveying direction and an upper tray;

DETAILED DESCRIPTION OF THE EMBODIMENTS

Figure 1:
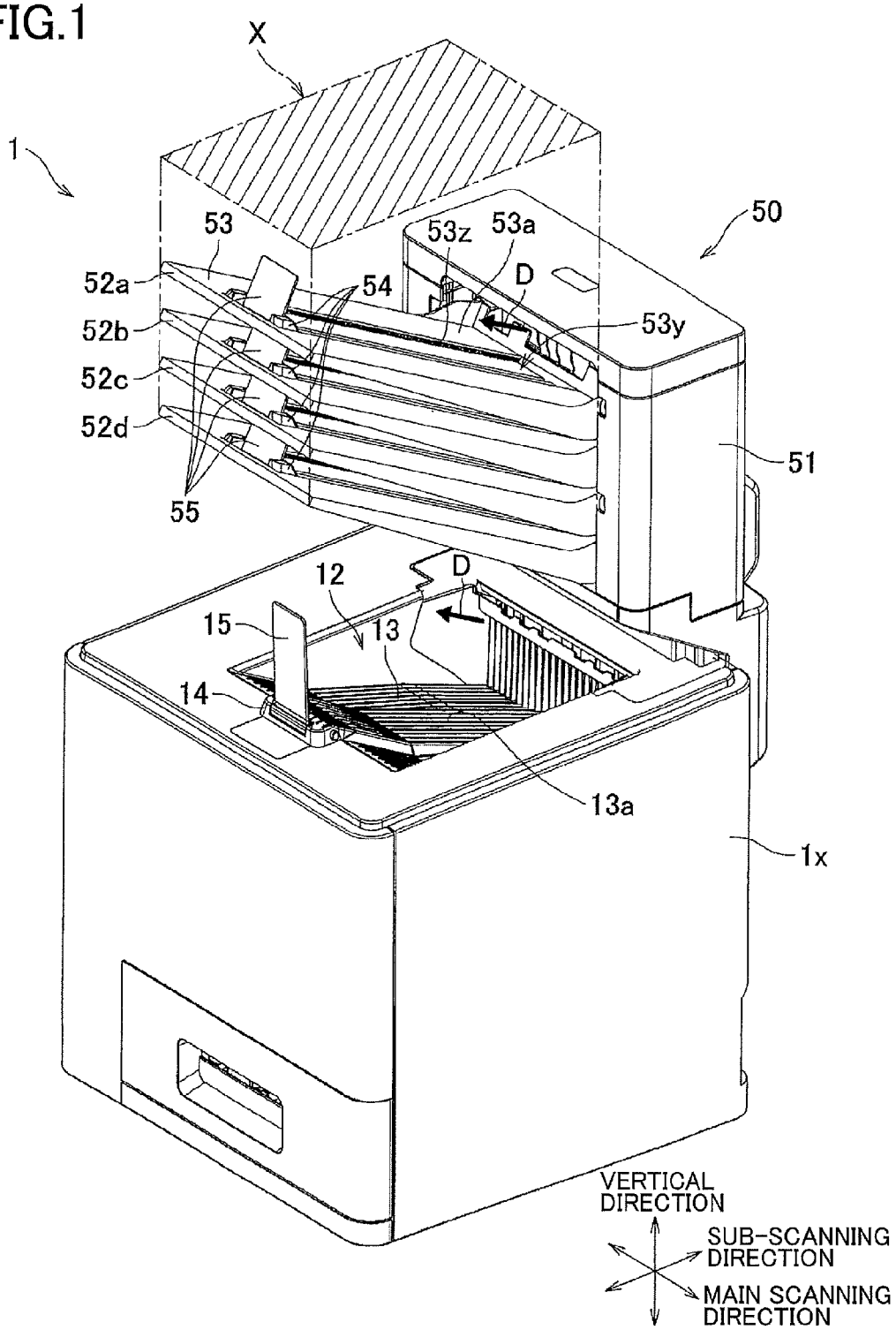
FIG. 1 is a perspective view of an ink-jet printer according to a first embodiment.
Figure 2:
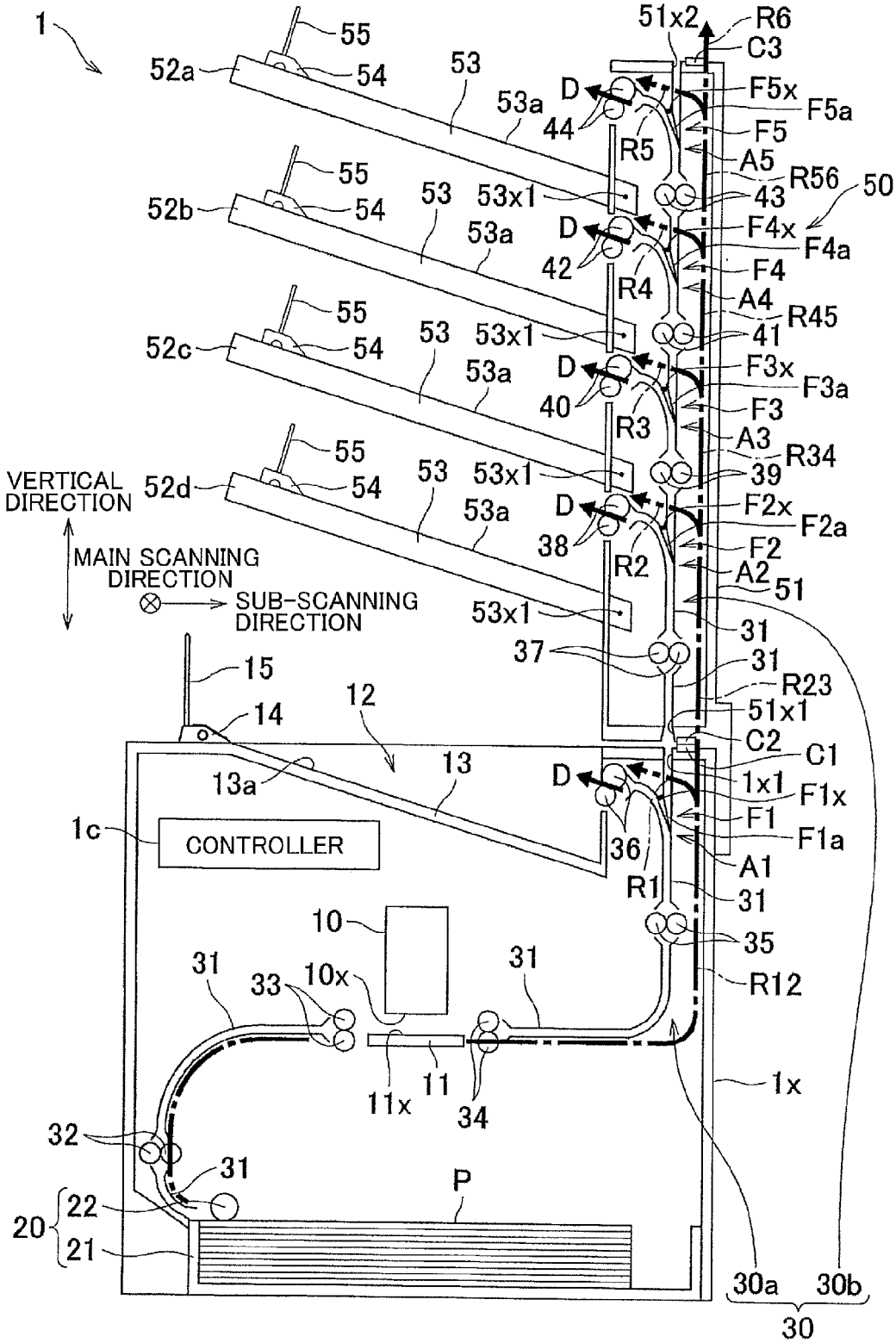
FIG. 2 is a schematic view of the ink-jet printer according to the first embodiment.

Hereinafter, there will be described embodiments by reference to the drawings. FIGS. 1 and 2 illustrate an ink-jet printer 1 according to a first embodiment. This ink-jet printer 1 is one example of a conveying apparatus and will be hereinafter simply referred to as "printer". As illustrated in FIGS. 1 and 2, the printer 1 includes a housing 1*x* having a substantially rectangular parallelepiped shape; and a tray unit 50 removably installed on the housing 1*x*. The tray unit 50 is disposed on an upper portion of the housing 1*x* such that an opening 1*x*1 formed in an upper surface of the housing 1*x* is opposed to an opening 51*x*1 formed in a lower surface of a supporter 51. Another tray unit may be additionally installed on an upper portion of the tray unit 50.

A receiving tray 12 is provided on the upper portion of the housing 1*x*.

The receiving tray 12 includes: a tray body 13 constituted by an upper board of the housing 1*x*; a base 14 removably mounted on the tray body 13; and a stopper 15 pivotable with respect to the base 14 about an axis extending in a main scanning direction. An upper surface of the tray body 13 serves as a receiving surface 13*a* for receiving a sheet P.

The tray unit 50 includes: four receiving trays 52*a*-52*d* arranged in the vertical direction; and the supporter 51 shaped like a housing and supporting the receiving trays 52*a*-52*d* so as to enable an swing operation of each of the receiving trays 52*a*-52*d* about an axis 53*x*1, as one example of a first axis, extending in the main scanning direction. The receiving tray 52*a* is an uppermost tray located at the highest position among the receiving trays 52*a*-52*d*. The receiving trays 52*b*-52*d* are lower trays. The receiving tray 52*d* is the lowest tray located at the lowest position among the receiving trays 52*a*-52*d*.

Each of the receiving trays 52*a*-52*d* includes: a tray body 53 shaped like a plate having a groove 53*y* in its upper surface; a base 54 removably mounted on the tray body 53 in the groove 53*y* so as to be movable in a conveying direction D in which the sheet P is discharged onto the receiving tray; and a stopper 55 pivotable with respect to the base 54 about an axis extending in the main scanning direction. An upper surface of the tray body 53 serves as a receiving surface 53*a* for receiving the sheet P.

Projective regions X are formed by projecting the receiving surfaces 13*a*, 53*a* of the respective receiving trays 12, 52*a*-52*d* in the vertical direction onto a virtual plane orthogonal to the vertical direction, and these projective regions X overlap each other.

The tray body 53 has opposite side surfaces which extend in the conveying direction D so as to define the groove 53*y*. A multiplicity of recesses 53*z* are formed in each of these opposite side surfaces and arranged in the conveying direction D. A pair of protrusions, not illustrated, are provided respectively on outer side surfaces of the base 54 in the main scanning direction. These protrusions are respectively fittable in any pair of the recesses 53*z* which are opposed to each other in the main scanning direction. When the pair of protrusions are respectively fitted in the pair of recesses 53*z*, the base 54 is positioned with respect to the tray body 53.

The supporter 51 covers an upstream end portion of each of the receiving trays 52*a*-52*d* in the conveying direction D to prevent a user from taking out the sheet P from the receiving surface 53*a* in the main scanning direction. The supporter 51 is one example of a restrictor.

The housing 1*x* contains an ink-jet head 10 as one example of a recorder, a platen 11, a sheet-supply mechanism 20, a conveying mechanism 30*a*, and a controller 1*c*. A conveying mechanism 30*b* is provided in the supporter 51.

The head 10 has a substantially rectangular parallelepiped shape elongated in the main scanning direction. That is, the printer 1 is a line ink-jet printer. The head 10 includes: a passage unit including ink passages respectively having pressure chambers; and actuators each configured to apply a pressure to a corresponding one of the pressure chambers of the passage unit. A lower surface of the head 10, i.e., a lower surface of the passage unit, serves as an ejection surface 10*x* having a multiplicity of ejection openings for ink ejection. The ink is supplied to the ink passages of the passage unit from a cartridge, not illustrated.

The platen 11 is disposed under the head 10. The platen 11 has a planar plate shape and has a support surface 11*x* for supporting the sheet P. The support surface 11*x* is spaced apart from the ejection surface 10*x* in the vertical direction so as to face the ejection surface 10*x*.

The sheet-supply mechanism 20 includes: a storage tray 21 removably inserted in the housing 1*x* and capable of storing a plurality of the sheets P; and a sheet-supply roller 22 mounted on the storage tray 21. The controller 1*c* drives a sheet-supply motor 20M (see FIG. 3) to rotate the sheet-supply roller 22. The sheet-supply roller 22 contacts an uppermost one of the sheets P stacked on the storage tray 21. In this state, the sheet-supply roller 22 is rotated to supply the sheet P.

The conveying mechanism 30*a* and the conveying mechanism 30*b* constitute a conveying mechanism 30. The conveying mechanism 30 conveys the sheet P such that the sheet P supplied from the sheet-supply mechanism 20 is conveyed through an area between the ejection surface 10*x* and the support surface 11*x* and selectively received by one of the receiving trays 12, 52*a*-52*d* and receiving trays of another tray unit disposed on the upper portion of the tray unit 50. The conveying mechanism 30 defines paths R1-R6.

The path R1 is a path through which the sheet P is conveyed toward the receiving tray 12. The path R2 is a path through which the sheet P is conveyed toward the receiving tray 52*d*. The path R3 is a path through which the sheet P is conveyed toward the receiving tray 52*c*. The path R4 is a path through which the sheet P is conveyed toward the receiving tray 52*b*. The path R5 is a path through which the sheet P is conveyed toward the receiving tray 52*a*. The path R6 is a path through the sheet P is conveyed toward one of the receiving trays of said another tray unit through an opening 51*x*2 formed in an upper surface of the supporter 51.

The paths R1, R2 share a common path R12 and branch off from this common path R12 at its one end, namely, a branch position A1. The paths R2, R3 share a common path R23 and branch off from this common path R23 at its one end, namely, a branch position A2. The paths R3, R4 share a common path R34 and branch off from this common path R34 at its one end, namely, a branch position A3. The paths R4, R5 share a common path R45 and branch off from this common path R45 at its one end, namely, a branch position A4. The paths R5, R6 share a common path R56 and branch off from this common path R56 at its one end, namely, a branch position A5.

The conveying mechanism 30*a* includes a guide 31 and roller pairs 32-36. The conveying mechanism 30*b* includes the guide 31 and roller pairs 37-44.

The guide 31 is disposed so as to be opposed to front and back surfaces of the sheet P conveyed along the paths R1-R6.

The roller pairs 32-36 are arranged along the path R1. The roller pairs 37, 38 are arranged along the path R2 branching off from the common path R12. The roller pairs 39, 40 are arranged along the path R3 branching off from the common path R23. The roller pairs 41, 42 are arranged along the path R4 branching off from the common path R34. The roller pairs 43, 44 are arranged along the path R5 branching off from the common path R45.

The controller 1*c* drives a conveying motor 30*a*M (see FIG. 3) to rotate the roller pairs 32-36. The controller 1*c* drives a conveying motor 30*b*M (see FIG. 3) to rotate the roller pairs 37-44. The rollers of each of the roller pairs 32-44 are rotated while nipping the sheet P to convey the sheet P.

Switchers F1-F5 are provided at the respective branch positions A1-A5 to switch a destination of the sheet P at the respective branch positions A1-A5. The switchers F1-F5 respectively include movable members F1*a*-F5*a* pivotable respectively about pivot shafts F1*x*-F5*x* each extending in the main scanning direction.

The controller 1*c* drives a switching motor F1M (see FIG. 3) to pivot the movable member F1*a* between a position (see FIG. 1) at which the movable member F1*a* guides the sheet P from the common path R12 to the path R1 and a position at which the movable member F1*a* guides the sheet P from the common path R12 to the path R2. The controller 1*c* drives a switching motor F2M (see FIG. 3) to pivot the movable member F2*a* between a position (see FIG. 1) at which the movable member F2*a* guides the sheet P from the common path R23 to the path R2 and a position at which the movable member F2*a* guides the sheet P from the common path R23 to the path R3. The controller 1*c* drives a switching motor F3M (see FIG. 3) to pivot the movable member F3*a* between a position (see FIG. 1) at which the movable member F3*a* guides the sheet P from the common path R34 to the path R3 and a position at which the movable member F3*a* guides the sheet P from the common path R34 to the path R4. The controller 1*c* drives a switching motor F4M (see FIG. 3) to pivot the movable member F4*a* between a position (see FIG. 1) at which the movable member F4*a* guides the sheet P from the common path R45 to the path R4 and a position at which the movable member F4*a* guides the sheet P from the common path R45 to the path R5. The controller 1*c* drives a switching motor F5M (see FIG. 3) to pivot the movable member F5*a* between a position (see FIG. 1) at which the movable member F5*a* guides the sheet P from the common path R56 to the path R5 and a position at which the movable member F5*a* guides the sheet P from the common path R56 to the path R6.

Figure 3:
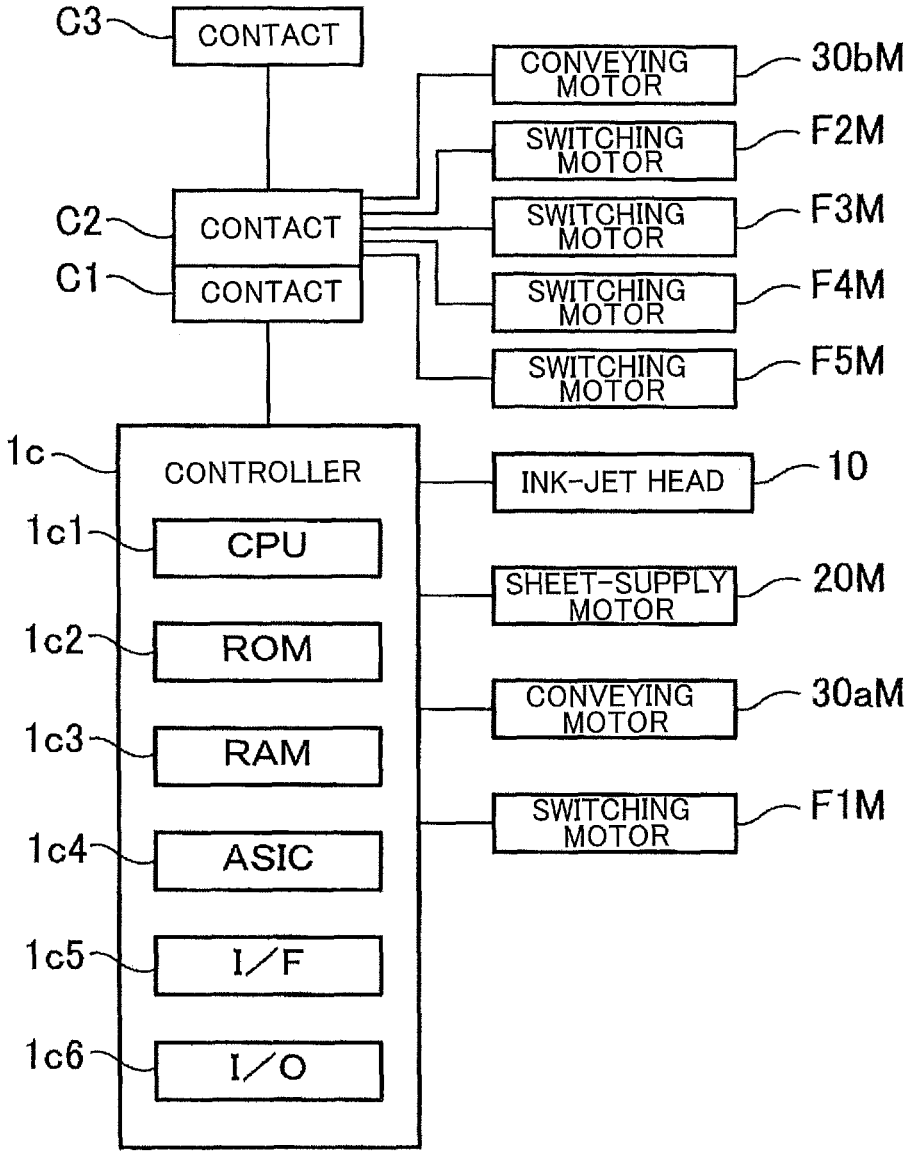
FIG. 3 is a block diagram illustrating an electric configuration of the ink-jet printer according to the first embodiment.

As illustrated in FIG. 3, the controller 1*c* includes: a central processing unit (CPU) 1*c*1 as a computing device; a read only memory (ROM) 1*c*2, a random access memory (RAM) 1*c*3, an application specific integrated circuit (ASIC) 1*c*4, an interface (I/F) 1*c*5, and an input/output port (I/O) 1*c*6. The ROM 1*c*2 stores fixed data used for programs to be executed by the CPU 1*c*1, for example. The RAM 1*c*3 temporarily stores data required for the CPU 1*c*1 to execute the programs. The ASIC 1*c*4 executes rewriting and sorting of image data and other processings such as a signal processing and an image processing. The interface 1*c*5 transmits and receives data to and from an external device such as a PC connected to the printer 1. The input/output port 1*c*6 transmits and receives signals to and from various kinds of sensors. The CPU 1*c*1 is electrically connected to the devices of the controller 1*c* other than the CPU 1*c*1 and executes control based on data received from the devices.

The controller 1*c* is electrically connected to a contact C1 provided on the upper surface of the housing 1*x*. When the tray unit 50 is installed on the housing 1*x*, the contact C1 and a contact C2 provided on the lower surface of the supporter 51 are brought into contact with each other and thereby electrically connected to each other. The contact C2 is electrically connected to the conveying motor 30*b*M and the switching motors F2M-F5M of the tray unit 50. This connection enables transfer of signals between the controller 1*c* and the conveying motor 30*b*M and the switching motors F2M-F5M of the tray unit 50.

When another tray unit is installed on the upper portion of the tray unit 50, a contact C3 provided on the upper surface of the supporter 51 of the tray unit 50 and another contact provided on a lower surface of a supporter of said another tray unit are brought into contact with each other and thereby electrically connected to each other. Said another contact is electrically connected to a conveying motor and switching motors of said another tray unit. This connection enables transfer of signals between the controller 1*c* and the conveying motor and the switching motors of said another tray unit.

When the sheet P conveyed by the conveying mechanism 30 passes through the area between the ejection surface 10*x* and the support surface 11*x*, the controller 1*c* controls the actuators of the head 10 to selectively eject the ink from the ejection openings to the sheet P. As a result, an image is formed on the sheet P. That is, image recording is performed on the sheet P. After the image recording, the sheet P is further conveyed by the conveying mechanism 30 and selectively received by one of the receiving trays 12, 52*a*-52*d*.

When the sheet P is received by one of the receiving trays 12, 52*a*-52*d*, the sheet P is conveyed in the conveying direction D, and then its leading end is brought into contact with a corresponding one of the stoppers 15, 55, so that the sheet P falls to a corresponding one of the receiving surfaces 13*a*, 53*a* of the respective receiving trays 12, 52*a*-52*d*.

There will be next explained, with reference to FIGS. 4A-6B, the construction of each of the receiving trays 52*a*-52*d* and positions of each of the receiving trays 52*a*-52*d*. It is noted that FIGS. 4A-6B omit illustration of the groove 53*y*, the recesses 53*z*, the base 54, and the stopper 55 of each of the receiving trays 52*a*-52*d*.

The tray body 53 of each of the receiving trays 52*b*-52*d* (the lower trays) includes a basal end portion 53X and a distal end portion 53Y located downstream of the basal end portion 53X in the conveying direction D. The basal end portion 53X has a portion 53*a*X of the receiving surface 53*a*, and the distal end portion 53Y has the other portion 52*a*Y of the receiving surface 53*a*. The basal end portion 53X is supported, at its upstream end in the conveying direction D, by the supporter 51 so as to be pivotable about the axis 53*x*1. A shaft 53Y2 is provided on an upstream end of the distal end portion 53Y in the conveying direction D. The distal end portion 53Y is mounted on the basal end portion 53X by the shaft 53Y2 so as to be pivotable about an axis 53Y1, as one example of a second axis, extending in the main scanning direction.

The tray body 53 of the receiving tray 52*a* (the uppermost tray) is constituted by a single plate member unlike the above-described tray body 53 constituted by the basal end portion 53X and the distal end portion 53Y. The tray body 53 of the receiving tray 52*a* (the uppermost tray) is supported, at its upstream end in the conveying direction D, by the supporter 51 so as to be pivotable about the axis 53*x*1.

Each of the receiving trays 52*b*-52*d* (the lower trays) is movable by pivotal movement of the distal end portion 53Y with respect to the basal end portion 53X and pivotal movement of the basal end portion 53X with respect to the supporter 51. Each of the receiving trays 52*b*-52*d* is selectively situated to one of a receiving position (see each of the receiving trays 52*b*-52*d* in FIG. 4A), an upper position (see the receiving tray 52*c* in FIG. 4B), and a lower position (see the receiving tray 52*d* in FIG. 6A). At the receiving position, each of the receiving trays 52*b*-52*d* receives the sheet P conveyed by the conveying mechanism 30. When each of the receiving trays 52*b*-52*d* is located at the upper position, a downstream end 53*b* of the tray body 53 in the conveying direction D is located at a higher position than when said each of the receiving trays 52*b*-52*d* is located at the receiving position. When each of the receiving trays 52*b*-52*d* is located at the lower position, the downstream end 53*b* is located at a lower position than when said each of the receiving trays 52*b*-52*d* is located at the receiving position. When each of the receiving trays 52*b*-52*d* is located at the receiving position, the receiving surface 53*a* is inclined so as to be higher at its downstream portion than at its upstream portion in the conveying direction D. When each of the receiving trays 52*b*-52*d* is located at the lower position, the receiving surface 53*a* extends in the horizontal direction.

Figure 4A:
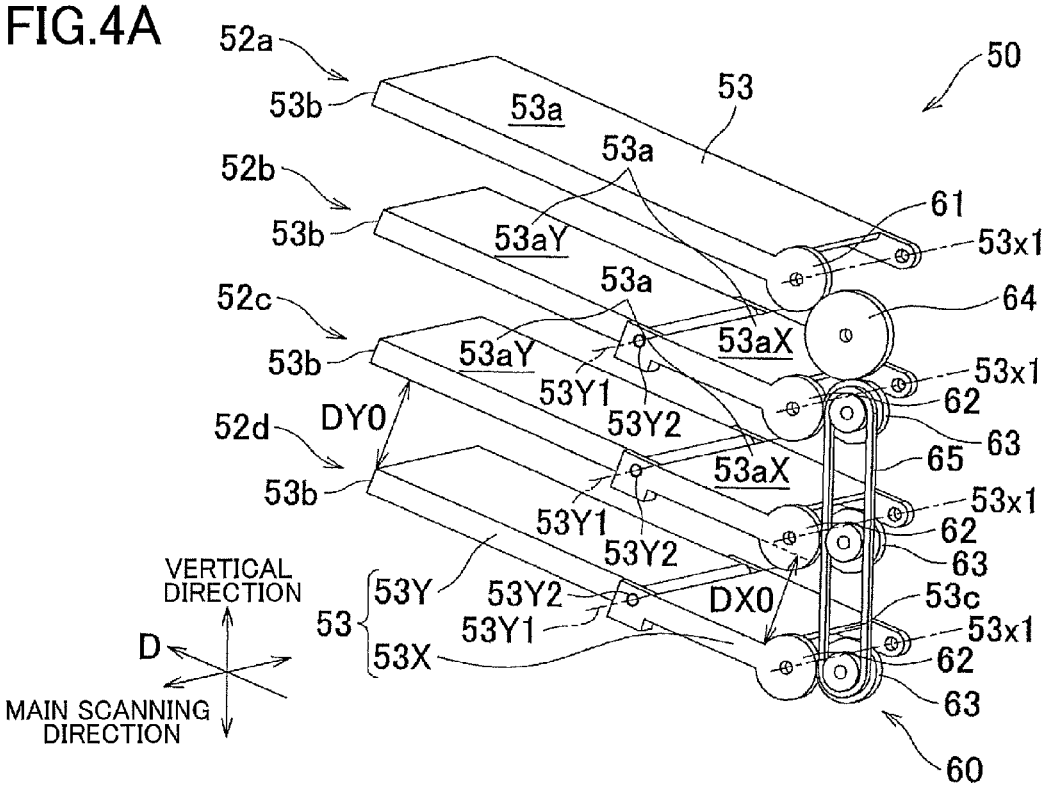
Figure 4B:
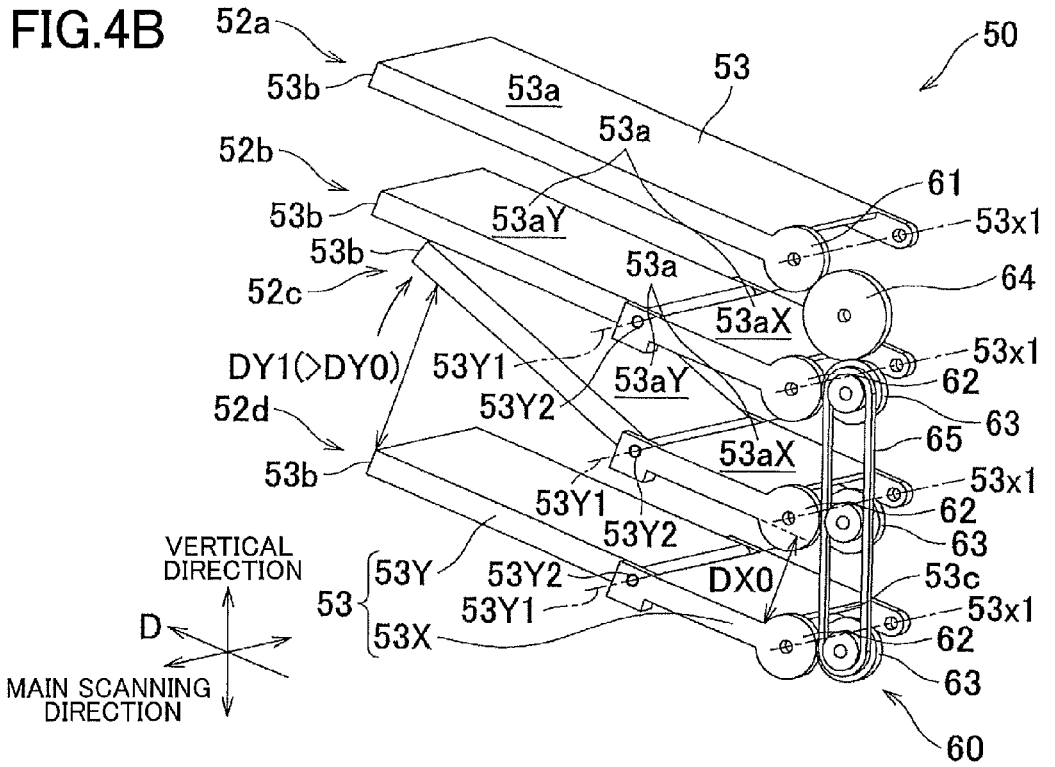
Figure 5A:
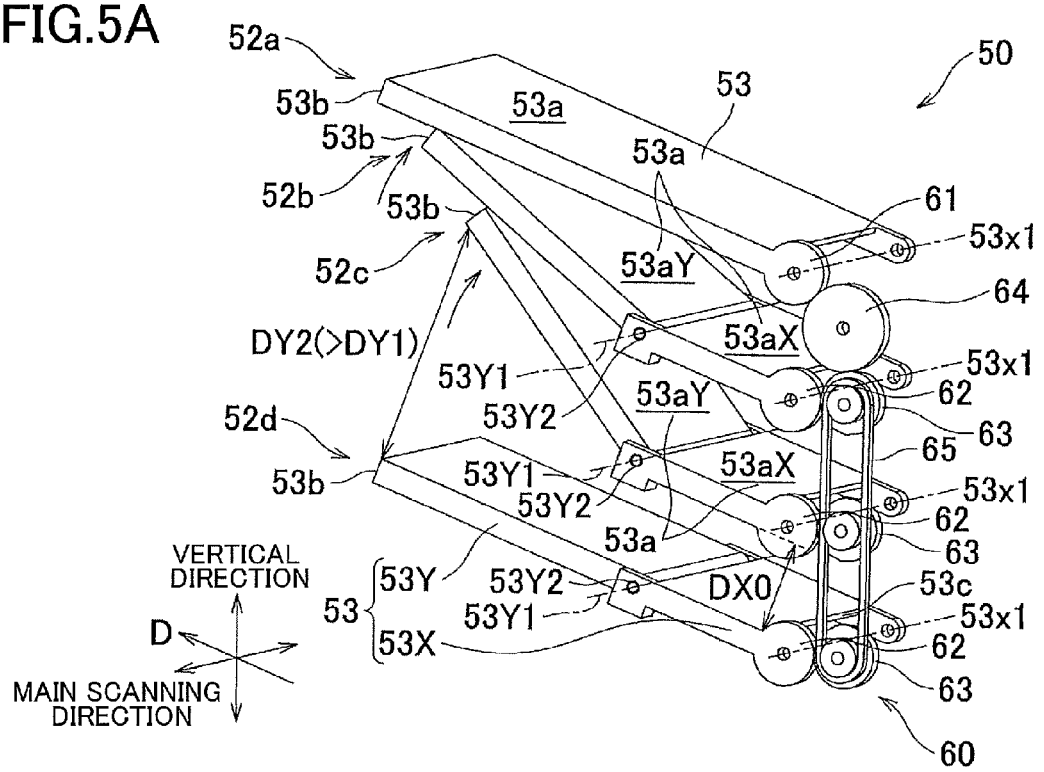
Figure 5B:
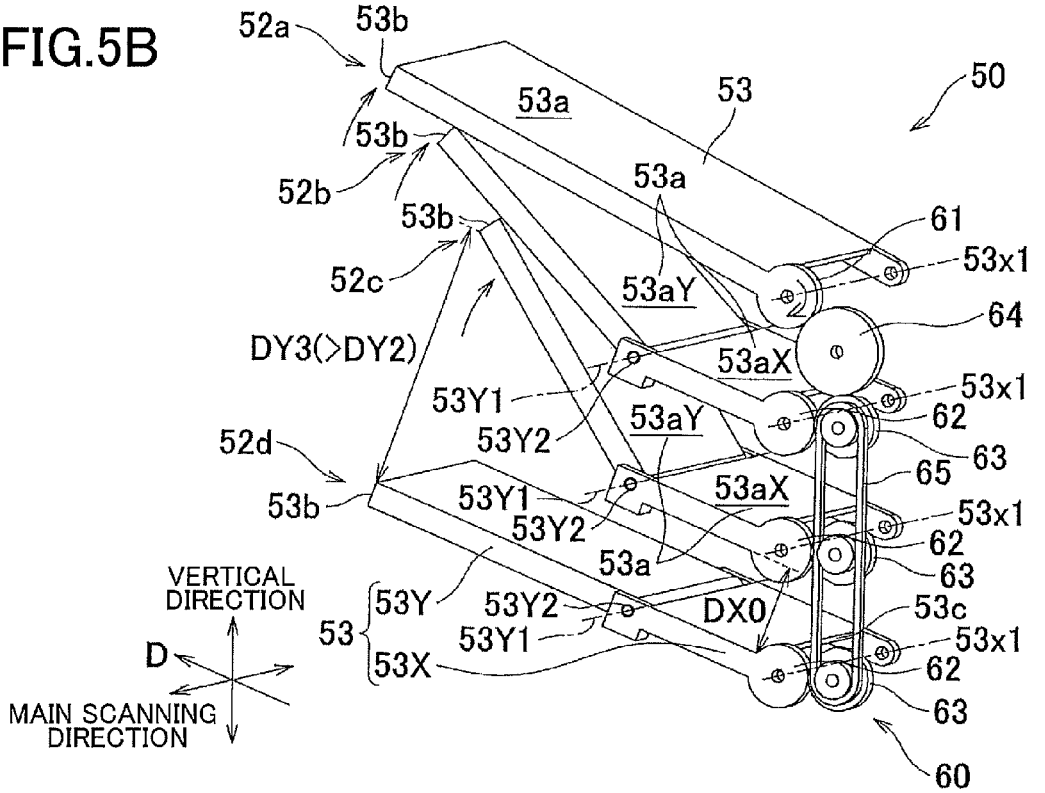

The receiving tray 52*a* (the uppermost tray) is pivotable with respect to the supporter 51 so as to be selectively situated at one of the receiving position (see FIG. 4A) and the upper position (see FIG. 5B).

Here, the receiving trays 52*a*-52*c* different from the lowest tray are defined as upper trays each as one example of a first receiving tray. Also, movement of each of the receiving trays 52*a*-52*c* (upper trays) from the receiving position to the upper position may be hereinafter referred to as "upward movement". Movement of each of the receiving trays 52*b*-52*d* from the receiving position to the lower position may be hereinafter referred to as "downward movement". The printer 1 includes a transmission mechanism 60 configured to transmit the upward movement of each of the receiving trays 52*a*-52*c* (upper trays) to the downward movement of a corresponding one of the receiving trays 52*b*-52*d* which is disposed just below the upper tray, with no tray interposed between. In other words, the transmission mechanism 60 transmits a force of the upward movement of each of the receiving trays 52*a*-52*c* (upper trays) to the corresponding receiving tray disposed just below the upper tray to cause the downward movement of the corresponding receiving tray. In this specification, an expression "a receiving tray just above or just below a certain receiving tray" means that the receiving tray is disposed just above or just below the certain receiving tray, with no tray interposed therebetween. Here, movement of each of the upper trays from the upper position to the receiving position may be hereinafter referred to as "first return movement". Movement of each of the receiving trays 52*b*-52*d* from the lower position to the receiving position may be hereinafter referred to as "second return movement". The transmission mechanism 60 transmits the first return movement of each of the upper trays to the second return movement of a corresponding one of the receiving trays 52*b*-52*d* which is disposed just below the upper tray. In other words, the transmission mechanism 60 transmits a force of the first return movement of each of the upper trays to the corresponding receiving tray disposed just below the upper tray to cause the second return movement of the corresponding receiving tray.

The transmission mechanism 60 includes: a gear 61 provided on an upstream end of the receiving tray 52*a* in the conveying direction D; gears 62 respectively provided on upstream ends of the respective receiving trays 52*b*-52*d* in the conveying direction D; gears 63 engaged with the respective gears 62; a gear 64 engaged with the gear 61 and the gear 63 provided on the receiving tray 52*b*; and a timing belt 65 looped over shafts of the three gears 63 provided on the respective receiving trays 52*b*-52*d*. These gears 61-64 and the timing belt 65 are connected to the basal end portions 53X of the respective receiving trays 52*b*-52*d*. The axis 53*x*1 is located at the center of each of the gears 61, 62.

There will be next explained transmission of the upward movement of the receiving tray 52*c* from the receiving position to the upper position, to the downward movement of the receiving tray 52*d* from the receiving position to the lower position, by the transmission mechanism 60.

When the receiving tray 52*c* is moved from the receiving position to the upper position by, for example, a manual operation of the user, as illustrated in FIGS. 4 and 5, the distal end portion 53Y of the receiving tray 52*c* is pivoted with respect to the basal end portion 53X so as to move the downstream end 53*b* upward. During this movement, the distance (DY0, DY1, DY2, DY3) between the downstream end 53*b* of the receiving tray 52*d* and the receiving tray 52*c* in a direction orthogonal to the receiving surface 53*a* of the receiving tray 52*d* gradually increases (DY0<DY1<DY2<DY3).

The downstream end 53*b* of the receiving tray 52*c* is brought into contact with the receiving tray 52*b* (see FIG. 4B) in the process in which the receiving tray 52*c* is moved from the receiving position to the upper position. When the receiving tray 52*c* is thereafter further moved toward the upper position, the receiving tray 52*b* is pushed upward by the receiving tray 52*c* so as to be moved from the receiving position toward the upper position, so that the downstream end 53*b* of the receiving tray 52*b* is brought into contact with the receiving tray 52*a* (see FIG. 5A). When the receiving tray 52*c* is thereafter further moved toward the upper position, the receiving tray 52*a* is pushed upward by the receiving tray 52*b* so as to be moved from the receiving position toward the upper position (see FIG. 5B). During this operation, the receiving tray 52*a* is pivoted about the axis 53*x*1 with respect to the supporter 51, thereby causing rotation of the gear 61 in the clockwise direction in FIG. 5B.

Figure 6A:
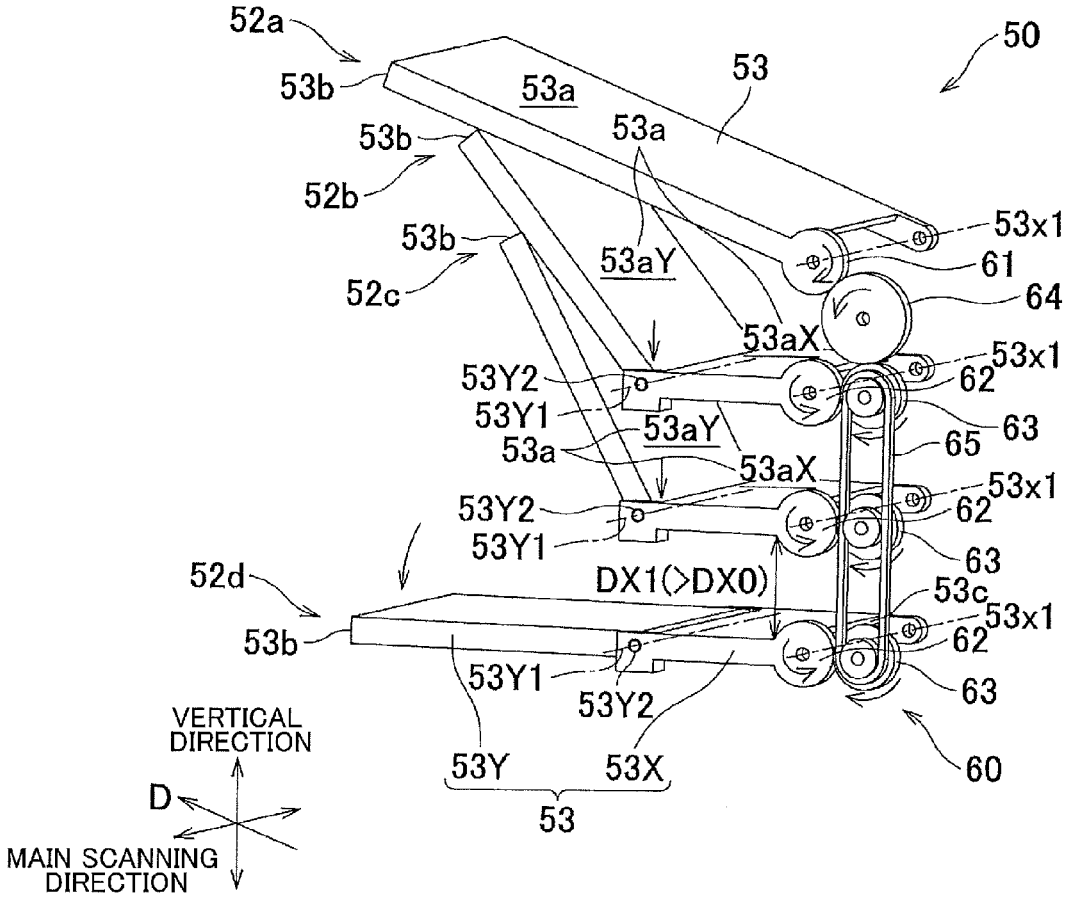
Figure 6B:
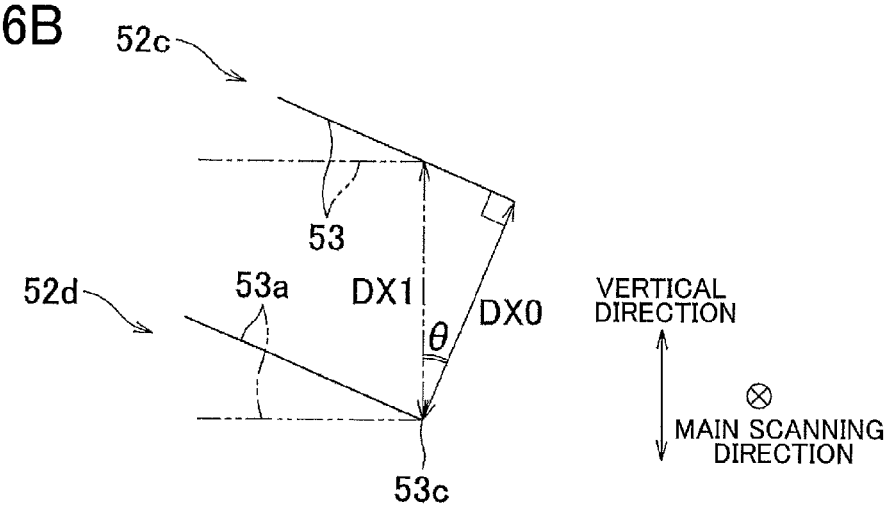

As illustrated in FIG. 6A, this rotation of the gear 61 is transmitted via the gear 64 to the gear 63 provided on the receiving tray 52*b*, thereby causing rotation of the gear 63 provided on the receiving tray 52*b*. This rotation of the gear 63 is transmitted via the timing belt 65 to the gears 63 of the respective receiving trays 52*c*, 52*d*, thereby causing rotation of the gears 63, so that the gears 62 engaged with the gears 63 of the respective receiving trays 52*b*-52*d* are rotated in the counterclockwise direction in FIG. 6A. As a result, each of the basal end portions 53X of the respective receiving trays 52*b*-52*d* is pivoted about the corresponding axis 53*x*1 with respect to the supporter 51, thereby establishing a state in which each of the basal end portions 53X extends in the horizontal direction. Also, the basal end portion 53X and the distal end portion 53Y of the receiving tray 52*d* extend in the horizontal direction. That is, the receiving tray 52*d* is situated to the lower position.

Until the receiving tray 52*a* is pivoted with respect to the supporter 51 after the receiving tray 52*c* starts to be moved from the receiving position toward the upper position, each of the basal end portions 53X of the respective receiving trays 52*b*-52*d* is kept parallel with the receiving tray 52*a*, so that a distance (DX0) between an upstream end 53*c* of the receiving tray 52*d* and an upstream end of the receiving tray 52*c* in the direction orthogonal to the receiving surface 53*a* of the receiving tray 52*d* does not change. When the receiving tray 52*a* is pivoted with respect to the supporter 51, and the receiving tray 52*d* is moved from the receiving position to the lower position by a force transmitted by the transmission mechanism 60, the above-described distance (DX1) increases (DX1>DX0). This is apparent from FIG. 6B. It is noted that θ in FIG. 6B indicates an angle of the basal end portion 53X of each of the receiving trays 52*b*-52*d* with respect to the supporter 51 when the receiving tray 52*d* is pivoted from the receiving position to the lower position.

In the case where the receiving tray 52*b* is moved from the receiving position to the upper position, the receiving tray 52*a* is contacted by the receiving tray 52*b* and pushed upward from the receiving position to the upper position. During this movement, the receiving tray 52*a* is pivoted about the axis 53*x*1, and the gears 61-64 are rotated as in the above-described case, thereby establishing a state in which each of the basal end portions 53X of the respective receiving trays 52*b*-52*d* extends in the horizontal direction. Also, the basal end portion 53X and the distal end portion 53Y of each of the receiving trays 52*c*, 52*d* extend in the horizontal direction. That is, each of the receiving trays 52*c*, 52*d* is situated to the lower position.

In the case where the receiving tray 52*a* is moved from the receiving position to the upper position, the receiving tray 52*a* is pivoted about the axis 53*x*1, and the gears 61-64 are rotated as in the above-described case, thereby establishing the state in which each of the basal end portions 53X of the respective receiving trays 52*b*-52*d* extends in the horizontal direction. Also, the basal end portion 53X and the distal end portion 53Y of each of the receiving trays 52*b*-52*d* extend in the horizontal direction. That is, each of the receiving trays 52*b*-52*d* is situated to the lower position.

There will be next explained transmission of the first return movement of the receiving tray 52*c* from the upper position to the receiving position, to the second return movement of the receiving tray 52*d* from the lower position to the receiving position, by the transmission mechanism 60.

When an external force applied to the receiving tray 52*c* in the direction directed from the receiving position toward the upper position is canceled by, for example, the user moving his or her hand off the receiving tray 52*c* in the state illustrated in FIG. 6A, i.e., the state in which the receiving tray 52*d* is located at the lower position, and each of the receiving trays 52*a*-52*c* is located at the upper position, the distal end portion 53Y of the receiving tray 52*c* is pivoted by its own weight with respect to the basal end portion 53X thereof, so that the downstream end 53*b* is moved downward. When the receiving tray 52*c* is separated from the receiving tray 52*b* by this movement, a force applied from the receiving tray 52*c* to the receiving tray 52*b* is canceled, so that the distal end portion 53Y of the receiving tray 52*b* is pivoted by its own weight with respect to the basal end portion 53X thereof, and thereby the downstream end 53*b* is moved downward. When the receiving tray 52*b* is separated from the receiving tray 52*a* by this movement, a force applied from the receiving tray 52*b* to the receiving tray 52*a* is canceled, so that the receiving tray 52*a* is pivoted by its own weight about the axis 53*x*1 with respect to the supporter 51, and thereby moved from the upper position back to the receiving position.

In this process, the gear 61 is rotated in a direction (the counterclockwise direction) reverse to the direction indicated in FIG. 6A. This rotation of the gear 61 is transmitted via the gear 64 to the gear 63 provided on the receiving tray 52*b*, causing rotation of the gear 63. This rotation of the gear 63 provided on the receiving tray 52*b* is transmitted via the timing belt 65 to the gears 63 provided on the respective receiving trays 52*c*, 52*d*, so that the gears 62 engaged with the respective gears 63 of the receiving trays 52*b*-52*d* are rotated in the clockwise direction in FIG. 6A. This rotation causes pivotal movement of each of the basal end portions 53X of the respective receiving trays 52*b*-52*d* about the corresponding axis 53*x*1, establishing a state in which each of the receiving trays 52*b*-52*d* is inclined as illustrated in FIG. 4A. That is, each of the receiving trays 52*a*-52*d* is moved back to the receiving position.

Detailed explanations are not provided for the case where the receiving tray 52*b* is moved from the upper position to the receiving position and the case where the receiving tray 52*a* is moved from the upper position to the receiving position. In these cases, the transmission mechanism 60 is driven in a principle similar to that in the above-described case, so that the receiving tray disposed just below the receiving tray to be moved from the upper position to the receiving position is moved from the lower position to the receiving position.

In the present embodiment as described above, in the case where the user takes out the sheet P from any one of the receiving trays 52*b*-52*d* (the lower tray as one example of a second receiving tray), when the upper tray disposed just above the lower tray is moved from the receiving position to the upper position, the lower tray is moved from the receiving position to the lower position. That is, not only the position of the upper tray but also the position of the lower tray is changed. Moreover, the presence of the transmission mechanism 60 eliminates the need for the user to individually perform an operation of moving the upper tray from the receiving position to the upper position and an operation of moving the lower tray from the receiving position to the lower position. This construction enables the user to easily take out the sheet P (especially, the sheet P of a small size in the conveying direction) from the lower tray.

The transmission mechanism 60 transmits the first return movement to the second return movement. This construction eliminates the need for the user to individually perform an operation of moving the upper tray from the upper position to the receiving position and an operation of moving the lower tray from the lower position to the receiving position after the user takes out the sheet P from the lower tray. This makes it easy for the user to return each of the receiving trays 52*a*-52*d* after taking out the sheet P from the lower tray.

The distance between the upstream end 53*c* of the receiving tray and the upstream end of the upper tray in the direction orthogonal to the receiving surface 53*a* of the receiving tray is greater when the receiving tray is located at the lower position than when the receiving tray is located at the receiving position (see FIG. 6, DX1>DX0). When the upper tray is moved from the receiving position to the upper position, and the lower tray is moved from the receiving position to the lower position, not only the distance between the upper tray and the downstream end 53*b* of the lower tray in the conveying direction D but also the distance between the upstream end of the upper tray and the upstream end 53*c* of the lower tray in the conveying direction D increases in the direction orthogonal to the receiving surface 53*a* of the lower tray. This construction makes it easy for the user to take out the sheet P from the lower tray (especially, the sheet P of a small size in the conveying direction).

Each of the receiving trays 52*a*-52*d* is supported by the supporter 51 so as to be pivotable about the corresponding axis 53*x*1. This construction is simpler than a construction in which each of the receiving trays 52*a*-52*d* is slid in the vertical direction, to move each of the receiving trays 52*a*-52*d* between the receiving position and a corresponding one of the upper position and the lower position.

Each of at least the receiving trays (the receiving trays 52*b*-52*d* in the present embodiment) different from the lowest tray among the plurality of receiving trays 52*a*-52*d* includes the basal end portion 53X and the distal end portion 53Y. The distal end portion 53Y is mounted on the basal end portion 53X so as to be pivotable about the axis 53Y1, and the transmission mechanism 60 is coupled to the basal end portion 53X, leading to the simple construction of the transmission mechanism 60.

When each of the receiving trays 52*b*-52*d* (the lower trays) is located at the lower position, the receiving surface 53*a* extends in the horizontal direction (see the receiving tray 52*d* in FIG. 6A). This construction makes it much easier for the user to take out the sheet P from the lower tray.

The transmission mechanism 60 transmits the upward movement to the downward movement via an upper member (the receiving tray 52*a*) which is disposed over the receiving tray and which moves in accordance with movement of the receiving tray from the receiving position to the upper position, leading to the simple construction of the transmission mechanism 60.

The uppermost tray (the receiving tray 52*a*) is the upper member in the present embodiment. This construction eliminates the need for providing an additional component as the upper member, leading to reduction in the number of components.

The restrictor (the supporter 51) is provided for each of the lower trays to prevent the user from taking out the sheet P from the receiving surface 53*a* in the main scanning direction. The sheets P received on the lower trays are difficult to take out in the main scanning direction due to the restrictor and accordingly the user takes out these sheets P in the conveying direction D. In the case where only the position of the upper tray is changed in this operation, it is difficult to take out the sheet P in the conveying direction D. In the present embodiment, however, not only the position of the upper tray but also the position of the lower tray is changed, facilitating taking out the sheet P in the conveying direction D.

Figure 7:
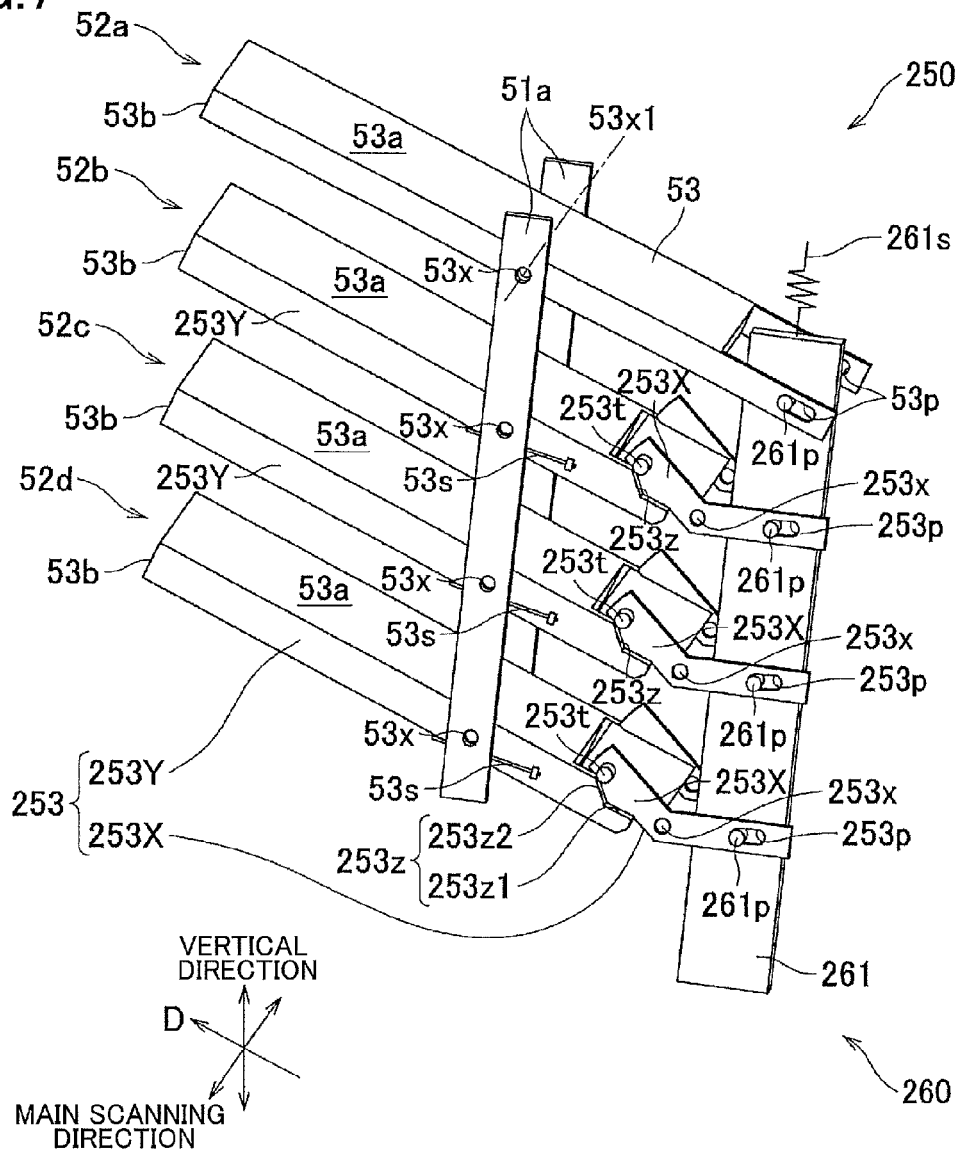
FIG. 7 is a perspective view of a transmission mechanism and four receiving trays of a tray unit of an ink-jet printer according to a second embodiment, illustrating a state in which each of the receiving trays is located at the receiving position.
Figure 8:
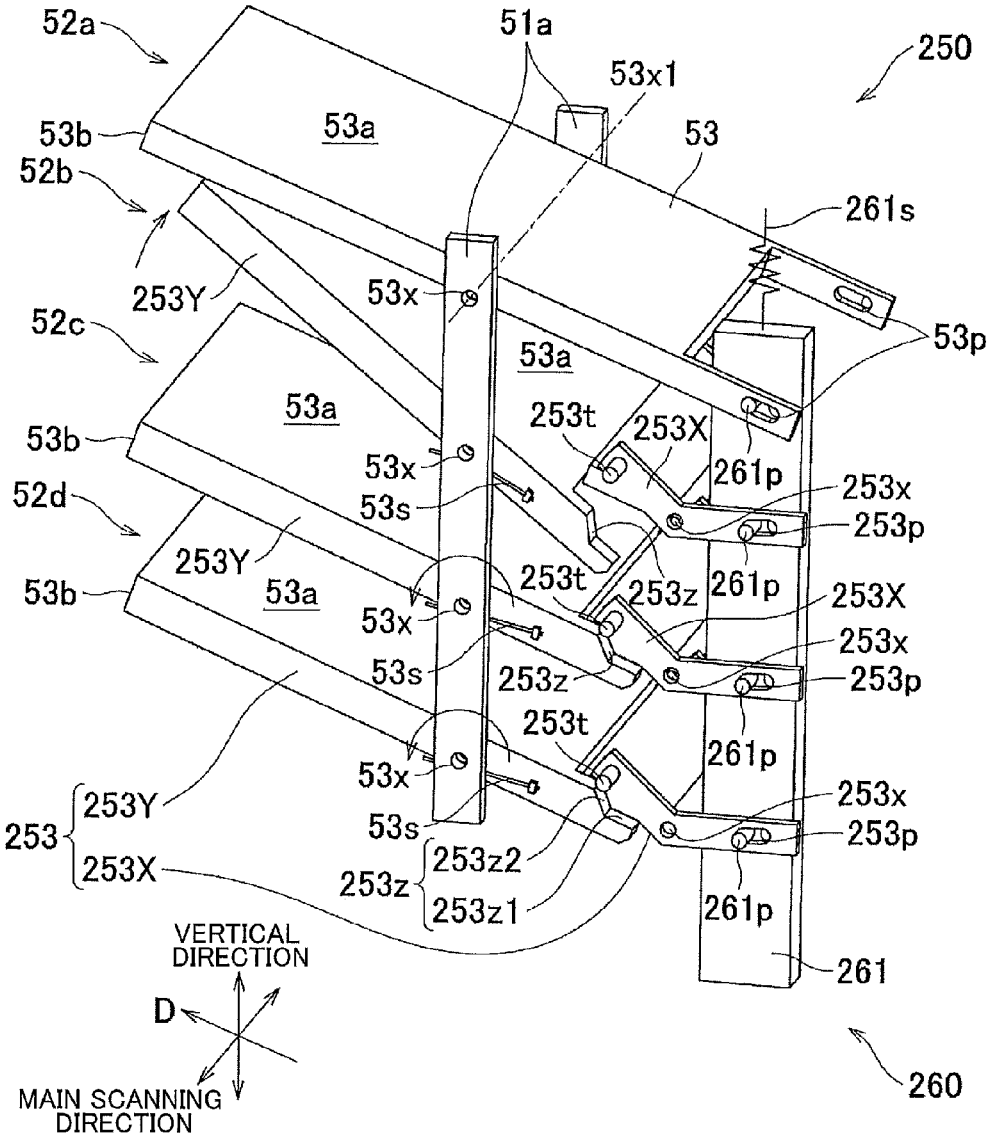
FIG. 8 is a perspective view of the transmission mechanism and the four receiving trays of the tray unit of the ink-jet printer according to the second embodiment, illustrating a state in which the uppermost tray is contacted by the second receiving tray from the top which is moved from the receiving position toward the upper position.
Figure 9:
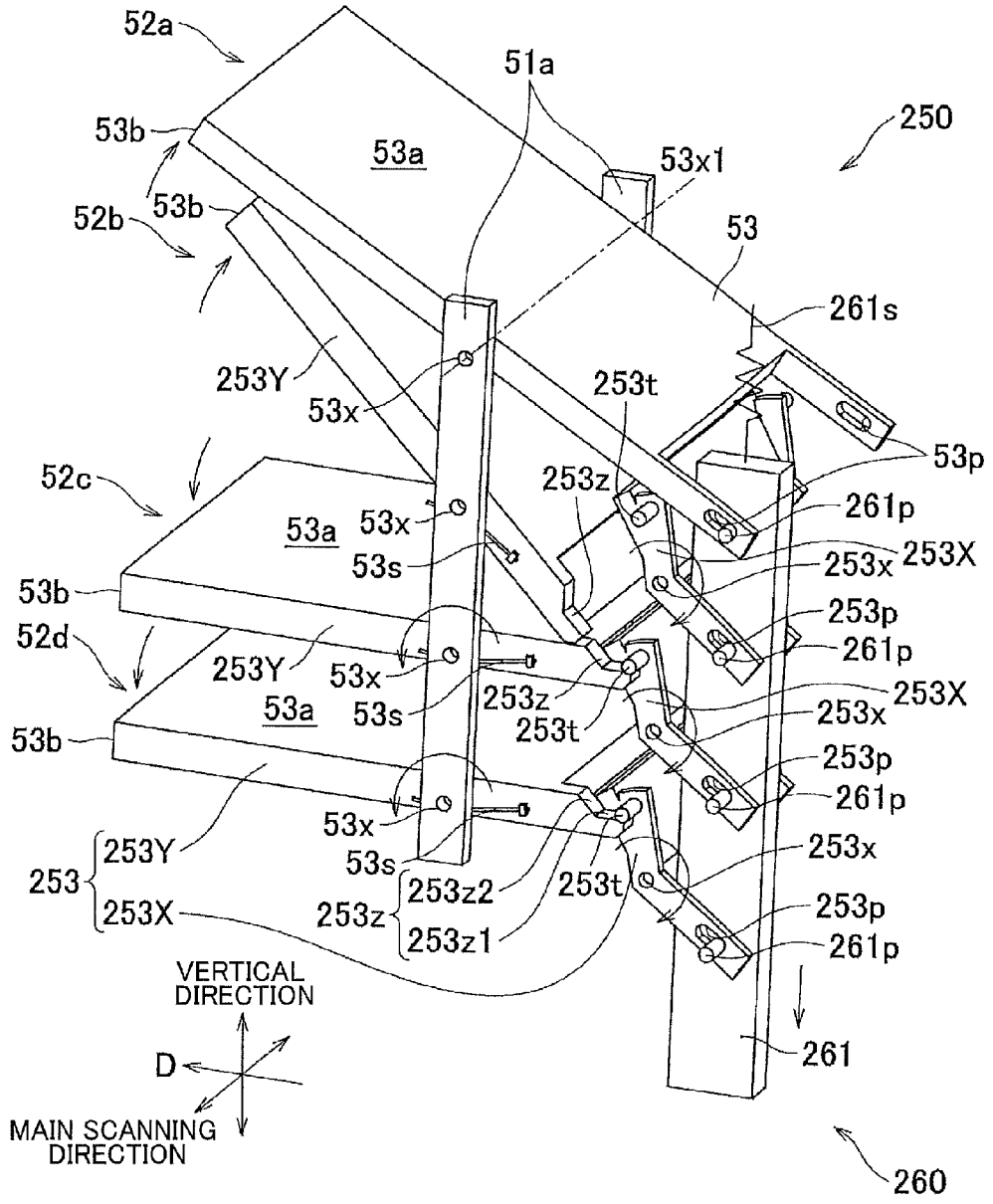
FIG. 9 is a perspective view of the transmission mechanism and the four receiving trays of the tray unit of the ink-jet printer according to the second embodiment, illustrating a state in which the third and fourth receiving trays from the top are moved to their respective lower positions by downward movement of a link due to the uppermost tray being pushed upward by the second receiving tray from the top.

There will be next explained a second embodiment with reference to FIGS. 7-9. A printer according to the second embodiment and the printer according to the first embodiment are different in constructions of the transmission mechanism and the receiving trays of the tray unit and are the same in the other configuration. Like FIGS. 4A-6B, FIGS. 7-9 omit illustration of the groove 53*y*, the recesses 53*z*, the base 54, and the stopper 55 of each of the receiving trays 52*a*-52*d*.

In a tray unit 250 according to the present embodiment, each of the receiving trays 52*b*-52*d* (the lower trays) different from the uppermost tray includes a tray body 253 having a basal end portion 253X and a distal end portion 253Y located downstream of the basal end portion 253X in the conveying direction D. The basal end portion 253X does not constitute the receiving surface 53*a*, and the distal end portion 253Y constitutes the receiving surface 53*a*.

Each of the tray body 53 of the receiving tray 52*a* (the uppermost tray) and the distal end portions 253Y of the respective receiving trays 52*b*-52*d* (the respective lower trays) is supported by a pair of plates 51*a* secured to the supporter 51 so as to be pivotable about a corresponding one of pivot shafts 53*x* having the respective the axes 53*x*1. The pair of plates 51*a* extend in the vertical direction, with the receiving trays 52*a*-52*d* interposed between the plates 51 in the main scanning direction.

In the present embodiment, a transmission mechanism 260 includes a pair of links 261 supported by the supporter 51 respectively via a pair of springs 261*s*. It is noted that that the links 261 are the same in construction, and the following description will be provided for one of the links 261. The spring 261*s* has: one end connected to an upper end of the link 261; and the other end connected to an upper wall of the supporter 51. The spring 261*s* urges the link 261 upward. The link 261 extends in the vertical direction at a position located upstream of the receiving trays 52*a*-52*d* in the conveying direction D. Protrusions 261*p* corresponding to the respective receiving trays 52*a*-52*d* are formed on a surface of the link 261. Each of the protrusions 261*p* protrudes from the surface of the link 261 in the main scanning direction so as to be inserted in a corresponding one of an elongated hole 53*p* formed in an upstream end portion of the tray body 53 of the receiving tray 52*a* in the conveying direction D and elongated holes 253*p* respectively formed in upstream end portions of the basal end portions 253X of the respective receiving trays 52*b*-52*d* in the conveying direction D.

The receiving tray 52*a* is supported by the pair of plates 51*a* via the pivot shafts 53*x* and by the link 261 via the protrusion 261*p*, whereby a position of the receiving tray 52*a* is determined.

The basal end portions 253X of the respective receiving trays 52*b*-52*d* are supported by the supporter 51 so as to be pivotable respectively about pivot shafts 253*x* each extending in the main scanning direction. Each of the basal end portions 253X is supported by the supporter 51 via a corresponding one of the pivot shafts 253*x* and by the link 261 via a corresponding one of the protrusions 261*p*, whereby a position of each of the basal end portions 253X is determined.

Step portions 253*z* are respectively provided on upstream ends of the distal end portions 253Y of the respective receiving trays 52*b*-52*d* in the conveying direction D. Protrusions 253*t* contactable with the respective step portions 253*z* are provided on downstream ends of the respective basal end portions 253X in the conveying direction D. Each of the step portions 253*z* has a lower surface 253*z*1 and an inclined surface 253*z*2 extending obliquely upward from a downstream end of the lower surface 253*z*1 in the conveying direction D.

For the receiving trays 52*b*-52*d*, torsion springs 53*s* are provided on the respective distal end portion 253Y. Each of the torsion springs 53*s* has: one end wound around a corresponding one of the pivot shafts 53*x*; and the other end fixed to a corresponding one of the distal end portions 253Y. Each of the distal end portions 253Y is urged by the corresponding spring 53*s* so as to be pivoted in a direction in which the downstream end 53*b* is moved downward (in the counterclockwise direction in FIGS. 7-9). As illustrated in FIG. 7, however, when the protrusion 253*t* is in contact with the inclined surface 253*z*2, the distal end portion 253Y is not pivoted and kept at the receiving position.

There will be next explained operations of the transmission mechanism 260.

Like the transmission mechanism 60 in the first embodiment, the transmission mechanism 260 transmits the upward movement to the downward movement and transmits the first return movement to the second return movement.

First, there will be explained transmission of the upward movement of the receiving tray 52*b* from the receiving position to the upper position, to the downward movement of the receiving tray 52*c* from the receiving position to the lower position, by the transmission mechanism 260.

When the receiving tray 52*b* is moved from the receiving position to the upper position by, for example, a manual operation of the user, as illustrated in FIGS. 7 and 8, the distal end portion 253Y of the receiving tray 52*b* is pivoted about the pivot shaft 53*x* so as to move the downstream end 53*b* thereof upward. This movement separates the distal end portion 253Y of the receiving tray 52*b* from the basal end portion 253X. The downstream end 53*b* of the receiving tray 52*b* is then brought into contact with the receiving tray 52*a*, and as illustrated in FIG. 9 the receiving tray 52*a* is pushed by the receiving tray 52*b* and thereby moved upward from the receiving position toward the upper position. During this movement, the receiving tray 52*a* is pivoted about the pivot shaft 53*x* such that an upstream end of the tray body 53 of the receiving tray 52*a* in the conveying direction D is moved downward.

When the upstream end is moved downward, the protrusion 261*p* is pushed downward by a portion of the receiving tray 52*a* which defines the elongated hole 53*p*, whereby the link 261 is moved downward against the urging force of the spring 261*s*. In accordance with this downward movement, upstream ends of the basal end portions 253X of the respective receiving trays 52*b*-52*d* in the conveying direction D are moved downward with the protrusions 261*p*, so that the receiving trays 52*b*-52*d* are pivoted about the respective pivot shafts 253*x* in the clockwise direction in FIG. 9.

During this pivotal movement, the protrusion 253*t* of each of the receiving trays 52*c*, 52*d* is moved from the inclined surface 253*z*2 to the lower surface 253*z*1 of the step portion 253*z*, whereby the distal end portion 253Y is pivoted about the pivot shaft 53*x* in the counterclockwise direction in FIG. 9, establishing the state in which each of the receiving trays 52*c*, 52*d* extends in the horizontal direction, that is, each of the receiving trays 52*c*, 52*d* is situated at the lower position.

In the case where the receiving tray 52*c* is moved from the receiving position to the upper position, the receiving tray 52*c* is brought into contact with the receiving tray 52*b* so as to push the receiving tray 52*b* upward, so that the receiving tray 52*b* is moved from the receiving position to the upper position, causing the receiving tray 52*a* to be pushed upward and moved from the receiving position to the upper position. During this movement, the receiving tray 52*a* is pivoted about the pivot shaft 53*x* such that the upstream end of the tray body 53 of the receiving tray 52*a* in the conveying direction D is moved downward, whereby the link 261 is moved downward, causing pivotal movement of the basal end portion 253X of each of the respective receiving trays 52*b*-52*d* about the corresponding pivot shaft 253*x* in the clockwise direction in FIG. 9. With this pivotal movement, the protrusion 253*t* of the receiving tray 52*d* is moved from the inclined surface 253*z*2 to the lower surface 253*z*1 of the step portion 253*z*, whereby the distal end portion 253Y is pivoted, establishing the state in which the receiving tray 52*d* extends in the horizontal direction, that is, the receiving tray 52*d* is situated at the lower position.

In the case where the receiving tray 52*a* is moved from the receiving position to the upper position, the receiving tray 52*a* is pivoted about the pivot shaft 53*x* such that the upstream end of the tray body 53 of the receiving tray 52*a* in the conveying direction D is moved downward, whereby the link 261 is moved downward, causing pivotal movement of the basal end portion 253X of each of the respective receiving trays 52*b*-52*d* about the corresponding pivot shaft 253*x* in the clockwise direction in FIG. 9. With this pivotal movement, the protrusion 253*t* of each of the receiving trays 52*b*-52*d* is moved from the inclined surface 253*z*2 to the lower surface 253*z*1 of the step portion 253*z*, whereby the distal end portion 253Y is pivoted, establishing the state in which each of the receiving trays 52*b*-52*d* extends in the horizontal direction, that is, each of the receiving trays 52*b*-52*d* is situated at the lower position.

There will be next explained transmission of the first return movement of the receiving tray 52*b* from the upper position to the receiving position, to the second return movement of the receiving tray 52*c* from the lower position to the receiving position, by the transmission mechanism 260.

When an external force applied to the receiving tray 52*b* in the direction directed from the receiving position toward the upper position is canceled by, for example, the user moving his or her hand off the receiving tray 52*b* in the state illustrated in FIG. 9, i.e., the state in which each of the receiving trays 52*c*, 52*d* is located at the lower position, and each of the receiving trays 52*a*, 52*b* is located at the upper position, the distal end portion 253Y of the receiving tray 52*b* is pivoted about the pivot shaft 53*x* by the urging force of the torsion spring 53*s* in the counterclockwise direction in FIG. 9 such that the downstream end 53*b* is moved downward. When the receiving tray 52*b* is thereby separated from the receiving tray 52*a*, a force applied from the receiving tray 52*b* to the receiving tray 52*a* is canceled, so that the receiving tray 52*a* is pivoted by the urging force of the torsion spring 53*s* about the pivot shaft 53*x* in the counterclockwise direction in FIG. 9 and thereby moved from the upper position back to the receiving position.

During this movement, the upstream end of the tray body 53 of the receiving tray 52*a* in the conveying direction D is moved upward, and the link 261 is moved upward by the movement of the upstream end and the urging force of the spring 261*s*. In accordance with this movement, the upstream ends of the basal end portions 253X of the respective receiving trays 52*b*-52*d* in the conveying direction D are moved upward with the respective protrusions 261*p*, and the basal end portions 253X are pivoted about the respective pivot shafts 253*x* in the counterclockwise direction in FIG. 9.

In accordance with this pivotal movement, the protrusion 253*t* of each of the receiving trays 52*c*, 52*d* is moved from the lower surface 253*z*1 to the inclined surface 253*z*2 of the step portion 253*z*, whereby the distal end portion 253Y of each of the receiving trays 52*c*, 52*d* is pivoted about the pivot shaft 53*x* in the clockwise direction in FIG. 9, and thereby each of the receiving trays 52*c*, 52*d* is thereby moved back to the receiving position. The protrusion 253*t* of the receiving tray 52*b* is brought into contact with the inclined surface 253*z*2, and the receiving tray 52*b* is moved back to the receiving position.

Detailed explanations are not provided for the case where the receiving tray 52*c* is moved from the upper position to the receiving position and the case where the receiving tray 52*a* is moved from the upper position to the receiving position. In these cases, the transmission mechanism 260 is driven in a principle similar to that in the above-described case, so that the receiving tray disposed just below the receiving tray to be moved from the upper position to the receiving position is moved from the lower position to the receiving position.

In the present embodiment as described above, as in the first embodiment, in the case where the user takes out the sheet P from any one of the receiving trays 52*b*-52*d* (the lower tray), when the upper tray is moved from the receiving position to the upper position, the lower tray is moved from the receiving position to the lower position. That is, not only the position of the upper tray but also the position of the lower tray is changed. Moreover, the presence of the transmission mechanism 260 eliminates the need for the user to individually perform the operation of moving the upper tray from the receiving position to the upper position and the operation of moving the lower tray from the receiving position to the lower position. This construction enables the user to easily take out the sheet P (especially, the sheet P of a small size in the conveying direction) from the lower tray.

Also in the present embodiment, the same configuration as employed in the first embodiment can achieve the same effects as obtained in the first embodiment.

Figure 10:
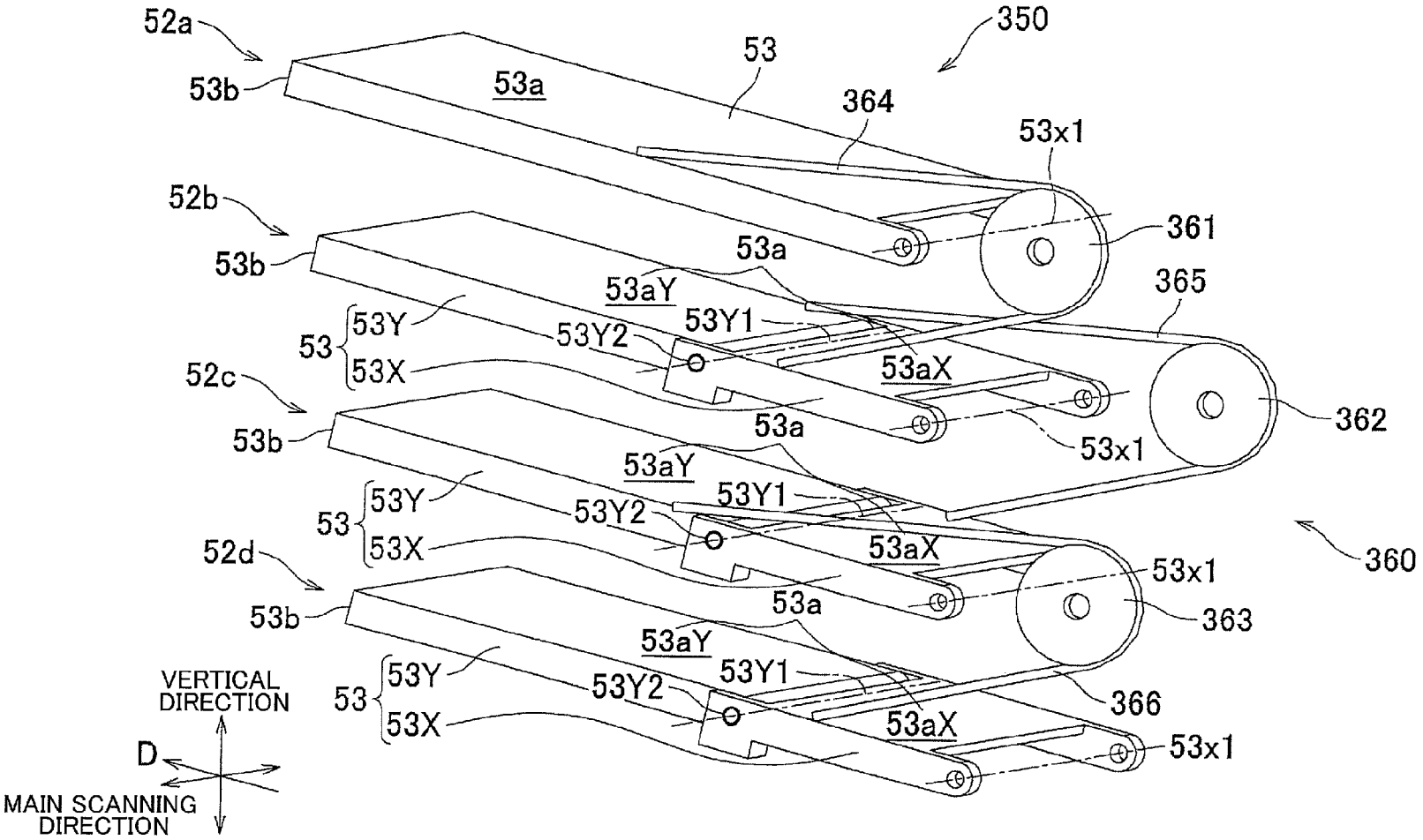
FIG. 10 is a perspective view of a transmission mechanism and four receiving trays of a tray unit of an ink-jet printer according to a third embodiment.

There will be next explained a third embodiment with reference to FIG. 10. A printer according to the third embodiment and the printer according to the first embodiment are different in construction of the transmission mechanism and are the same in the other configuration. Like FIGS. 4A-6B, FIG. 10 omits illustration of the groove 53*y*, the recesses 53*z*, the base 54, and the stopper 55 of each of the receiving trays 52*a*-52*d*.

In a tray unit 350 according to the present embodiment, a transmission mechanism 360 includes pulleys 361-363 and wires 364-366.

The wire 364 has: one end fixed to the tray body 53 of the receiving tray 52*a*; and the other end fixed to the basal end portion 53X of the receiving tray 52*b*. The wire 364 is wound around the pulley 361. The wire 365 has: one end fixed to the distal end portion 53Y of the receiving tray 52*b*; and the other end fixed to the basal end portion 53X of the receiving tray 52*c*. The wire 365 is wound around the pulley 362. The wire 366 has: one end fixed to the distal end portion 53Y of the receiving tray 52*c*; and the other end fixed to the basal end portion 53X of the receiving tray 52*d*. The wire 366 is wound around the pulley 363.

There will be explained operations of the transmission mechanism 360.

Like the transmission mechanism 60 in the first embodiment, the transmission mechanism 360 transmits the upward movement to the downward movement and transmits the first return movement to the second return movement. The transmission mechanism 360 further transmits the downward movement to the upward movement and transmits the second return movement to the first return movement.

It is noted that operations of two receiving trays next to each other in the vertical direction are explained in the following explanation. The other receiving trays are also moved with movement of the two receiving trays, but explanation of operations of the other receiving trays is omitted.

First, there will be explained transmission of the upward movement to the downward movement by the transmission mechanism 360.

When any one of the receiving trays 52*a*-52*c* (the upper tray) is moved from the receiving position to the upper position by, for example, a manual operation of the user, one end of a corresponding one of the wires 364-366 which is fixed to the upper tray is moved toward a corresponding one of the pulleys 361-363 in the conveying direction D. This movement rotates the corresponding pulley in the clockwise direction in FIG. 10, thereby moving the other end of the corresponding wire away from the corresponding pulley in the conveying direction D. As a result, the tray body 53 of the receiving tray disposed just below the upper tray is pivoted about the axis 53*x*1 with respect to the supporter 51, establishing a state in which the basal end portion 53X and the distal end portion 53Y of the receiving tray extend in the horizontal direction, that is, the receiving tray is situated at the lower position.

There will be next explained transmission of the downward movement to the upward movement by the transmission mechanism 360.

When any one of the receiving trays 52*b*-52*d* (the lower tray) is moved from the receiving position to the lower position by, for example, a manual operation of the user, the other end of a corresponding one of the wires 364-366 which is fixed to the lower tray is moved away from a corresponding one of the pulleys 361-363 in the conveying direction D. This movement rotates the corresponding pulley in the clockwise direction in FIG. 10, so that one end of the corresponding wire is moved toward the corresponding pulley in the conveying direction D. As a result, the tray body 53 of the upper tray is pivoted about the axis 53*x*1 with respect to the supporter 51 to move the downstream end 53*b* upward from the receiving position to the upper position.

There will be next explained transmission of the first return movement to the second return movement by the transmission mechanism 360.

When an external force applied to any one of the receiving trays 52*a*-52*c* (the upper tray) in the direction directed from the receiving position toward the upper position is canceled by, for example, the user moving his or her hand off the upper tray in a state in which the upper tray is located at the upper position, and the receiving tray located just below the upper tray is located at the lower position, the upper tray is moved by its own weight from the upper position to the receiving position. During this movement, one end of a corresponding one of the wires 364-366 which is fixed to the upper tray is moved away from a corresponding one of the pulleys 361-363 in the conveying direction D. This movement rotates the corresponding pulley in the counterclockwise direction in FIG. 10, so that the other end of the corresponding wire is moved toward the corresponding pulley in the conveying direction D. As a result, the tray body 53 of the receiving tray disposed just below the upper tray is pivoted about the axis 53*x*1 with respect to the supporter 51 so as to move back to the receiving position.

There will be next explained transmission of the second return movement to the first return movement by the transmission mechanism 360.

When the receiving tray disposed just below any one of the receiving trays 52*a*-52*c* (the upper tray) is moved from the lower position to the receiving position by, for example, a manual operation of the user in a state in which the upper tray is located at the upper position, and the receiving tray disposed just below the upper tray is located at the lower position, the other end of a corresponding one of the wires 364-366 which is fixed to the receiving tray disposed just below the upper tray is moved toward a corresponding one of the pulleys 361-363 in the conveying direction D. This movement rotates the corresponding pulley in the counterclockwise direction in FIG. 10, so that one end of the corresponding wire is moved away from the corresponding pulley in the conveying direction D. As a result, the tray body 53 of the upper tray is pivoted about the axis 53*x*1 with respect to the supporter 51 so as to move back to the receiving position.

In the present embodiment as described above, as in the first embodiment, in the case where the user takes out the sheet P from any one of the receiving trays 52*b*-52*d* (the lower tray), when the upper tray is moved from the receiving position to the upper position, the lower tray is moved from the receiving position to the lower position. Also, in the present embodiment, when the lower tray is moved from the receiving position to the lower position, the upper tray is moved from the receiving position to the upper position. That is, not only the position of the upper tray but also the position of the lower tray is changed. Moreover, the presence of the transmission mechanism 360 eliminates the need for the user to individually perform the operation of moving the upper tray from the receiving position to the upper position and the operation of moving the lower tray from the receiving position to the lower position. This construction enables the user to easily take out the sheet P (especially, the sheet P of a small size in the conveying direction) from the lower tray.

Also in the present embodiment, the same construction as employed in the first embodiment can achieve the same effects as obtained in the first embodiment.

While the embodiments have been described above, it is to be understood that the disclosure is not limited to the details of the illustrated embodiments, but may be embodied with various changes and modifications, which may occur to those skilled in the art, without departing from the spirit and scope of the disclosure.

The stopper and the base may not be provided on the receiving tray. Each of the receiving trays different from the lowest tray may not be situated at the lower position. Each of the lower trays may not be situated at the upper position. The way to move the receiving tray selectively to one of the receiving position, the upper position, and the lower position is not limited to pivotal movement of the receiving tray with respect to the supporter and may be sliding of the receiving tray with respect to the supporter.

The receiving position is not limited to the position at which the receiving surface is inclined so as to be higher at its downstream portion than at its upstream portion in the conveying direction and may be a position at which the receiving surface extends in the horizontal direction. The lower position is not limited to the position at which the receiving surface extends in the horizontal direction and may be a position at which the receiving surface is inclined with respect to the horizontal direction. The lower position is not limited to the position at which the distance between the upstream end of the receiving tray (the lower receiving tray) in the conveying direction and the upstream end of the receiving tray disposed just above the lower receiving tray, in the direction orthogonal to the receiving surface of the lower receiving tray is greater when the lower receiving tray is located at the lower position than when the lower receiving tray is located at the receiving position. The lower position may be a position at which the distance is the same between when the lower receiving tray is located at the lower position and when the lower receiving tray is located at the receiving position.

In the first through third embodiments, the uppermost tray (the receiving tray 52*a*) may have a basal end portion and a distal end portion like the lower trays (52*b*-52*d*). The lowest tray (the receiving tray 52*d*) may be constituted by a single plate member like the uppermost tray (the receiving tray 52*a*). The basal end portion may or may not constitute the receiving surface. In the case where three or more receiving trays are provided, when the upper tray and the lower tray are moved, the other receiving tray or trays may or may not be moved.

The transmission mechanism may be provided with an operating member which is manually operated by the user to operate the transmission mechanism. For example, a dial operating member may be provided on any one of the gears 61-64. The transmission mechanism at least has to perform both or one of the transmission of the upward movement to the downward movement and the transmission of the downward movement to the upward movement. The transmission mechanism at least has to perform both or one of the transmission of the first return movement to the second return movement and the transmission of the first return movement to the second return movement. Alternatively, the transmission mechanism may not perform the transmission of the first return movement to the second return movement and the transmission of the second return movement to the first return movement. The upper member is not limited to the uppermost tray and may be a component different from the receiving tray.

The conveying apparatus is not limited to the printer. Other examples of the conveying apparatus include a facsimile machine, a copying machine, and a multi-function peripheral (MFP). The recorder is not limited to the line recorder and may be a serial recorder. The recorder is not limited to the ink-jet recorder and may be a laser recorder and a thermal recorder, for example. The conveying apparatus may not include the recorder. The medium is not limited to the sheet and may be a cloth, for example. The medium is not limited to one on which image recording is performed and may be one on which image recording is not performed.

What is claimed is:

1. A conveying apparatus, comprising:

a plurality of receiving trays each comprising a receiving surface configured to receive a medium, the plurality of receiving trays being arranged in a vertical direction, the plurality of receiving trays comprising (i) a lowest tray located at a lowest position among the plurality of receiving trays and (ii) a first receiving tray that is each of at least one of the plurality of receiving trays other than the lowest tray;

a conveying mechanism configured to convey the medium to the receiving surface of one of the plurality of receiving trays, selectively; and a supporter supporting the plurality of receiving trays, the first receiving tray being supported by the supporter so as to be situated selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position, the plurality of receiving trays comprising: an uppermost tray located at a highest position among the plurality of receiving trays; and at least one second receiving tray that is at least one of the plurality of receiving trays other than the uppermost tray, each second receiving tray of the at least one second receiving tray being supported by the supporter so as to be situated selectively to one of the receiving position and a lower position at which a position of a downstream end of said each second receiving tray in the conveying direction is lower than a position of the downstream end of said each second receiving tray located at the receiving position, the at least one second receiving tray comprising one second receiving tray disposed just below the first receiving tray, with no receiving tray between the one second receiving tray and the first receiving tray, the conveying apparatus further comprising a transmission mechanism configured to perform at least one of: transmission of upward movement that is movement of the first receiving tray from the receiving position to the upper position, to downward movement that is movement of the one second receiving tray disposed just below the first receiving tray from the receiving position to the lower position; and transmission of the downward movement of the one second receiving tray to the upward movement of the first receiving tray.

2. The conveying apparatus according to claim 1, wherein the transmission mechanism is configured to further perform at least one of: transmission of first return movement that is movement of the first receiving tray from the upper position to the receiving position, to second return movement that is movement of the one second receiving tray disposed just below the first receiving tray from the lower position to the receiving position; and transmission of the second return movement of the one second receiving tray to the first return movement of the first receiving tray.

3. The conveying apparatus according to claim 1, wherein a distance between an upstream end of said each second receiving tray in the conveying direction and an upstream end of one of the plurality of receiving trays in the conveying direction, which one is disposed just above said each second receiving tray, is greater when said each second receiving tray is located at the lower position than when said each second receiving tray is located at the receiving position.

4. The conveying apparatus according to claim 1, wherein each of the plurality of receiving trays is supported by the supporter so as to be pivotable about a first axis extending in an orthogonal direction that is orthogonal to both of the vertical direction and the conveying direction.

5. The conveying apparatus according to claim 4, wherein the first receiving tray comprises a basal end portion and a distal end portion located downstream of the basal end portion in the conveying direction, wherein the distal end portion is mounted on the basal end portion so as to be pivotable about a second axis extending in the orthogonal direction, and wherein the transmission mechanism is coupled to the distal end portion.

6. The conveying apparatus according to claim 1, wherein the receiving surface of said each second receiving tray extends in a horizontal direction when said each second receiving tray is located at the lower position.

7. The conveying apparatus according to claim 1, wherein the transmission mechanism comprises an upper member disposed above the first receiving tray and configured to move with the movement of the first receiving tray from the receiving position to the upper position, and wherein the upper member is configured to perform the at least one of the transmission of the upward movement of the first receiving tray to the downward movement of the one second receiving tray and the transmission of the downward movement of the one second receiving tray to the upward movement of the first receiving tray.

8. The conveying apparatus according to claim 7, wherein the upper member is the uppermost tray.

9. The conveying apparatus according to claim 1, wherein at least a portion of a projective region formed by projecting the receiving surface of said each second receiving tray in the vertical direction onto a virtual plane orthogonal to the vertical direction overlaps a projective region formed by projecting any of at least one of the plurality of receiving trays which is disposed above said each second receiving tray, onto the virtual plane in the vertical direction.

10. The conveying apparatus according to claim 1, further comprising a restrictor configured to restrict taking of the medium from the receiving surface of said each second receiving tray in an orthogonal direction that is orthogonal to both of the vertical direction and the conveying direction.

11. A tray unit used for a conveying apparatus, the conveying apparatus comprising (a) a plurality of receiving trays each comprising a receiving surface configured to receive a medium, the plurality of receiving trays being arranged in a vertical direction, the plurality of receiving trays comprising (i) a lowest tray located at a lowest position among the plurality of receiving trays and (ii) a first receiving tray that is each of at least one of the plurality of receiving trays other than the lowest tray, (b) a conveying mechanism configured to convey the medium to the receiving surface of one of the plurality of receiving trays, selectively, and (c) a supporter supporting the plurality of receiving trays, the tray unit comprising the plurality of receiving trays, the first receiving tray being supported by the supporter so as to be situated selectively to one of a receiving position at which the first receiving tray receives the medium conveyed by the conveying mechanism and an upper position at which a position of a downstream end of the first receiving tray in a conveying direction in which the medium is conveyed by the conveying mechanism is higher than a position of the downstream end of the first receiving tray located at the receiving position, the plurality of receiving trays comprising: an uppermost tray located at a highest position among the plurality of receiving trays; and at least one second receiving tray that is at least one of the plurality of receiving trays other than the uppermost tray, each second receiving tray of the at least one second receiving tray being supported by the supporter so as to be situated selectively to one of the receiving position and a lower position at which a position of a downstream end of said each second receiving tray in the conveying direction is lower than a position of the downstream end of said each second receiving tray located at the receiving position, the at least one second receiving tray comprising one second receiving tray disposed just below the first receiving tray, with no receiving tray between the one second receiving tray and the first receiving tray, the tray unit further comprising a transmission mechanism configured to perform at least one of: transmission of upward movement that is movement of the first receiving tray from the receiving position to the upper position, to downward movement that is movement of the one second receiving tray disposed just below the first receiving tray from the receiving position to the lower position; and transmission of the downward movement of the one second receiving tray to the upward movement of the first receiving tray.

* * * * *